United States Patent [19]

Stewart

[11] 4,082,389

[45] Apr. 4, 1978

[54] COLLAPSIBLE CAMP SUPPLY UNIT

[76] Inventor: Glenn M. Stewart, 2929 Blakeley Ave., Eau Claire, Wis. 54701

[21] Appl. No.: 763,370

[22] Filed: Jan. 28, 1977

[51] Int. Cl.[2] ..... A47B 43/00; A47B 48/00

[52] U.S. Cl. ..... 312/258

[58] Field of Search ..... 108/111; 312/258, 5-6; 297/440, 442

[56] References Cited

U.S. PATENT DOCUMENTS

| | | | |
|---|---|---|---|
| 754,613 | 3/1904 | Schuster | 312/6 |
| 2,366,676 | 1/1945 | Rosenthal | 108/111 |
| 3,140,133 | 7/1964 | Kraft | 312/258 |
| 3,519,318 | 7/1970 | Hagen | 312/6 |

FOREIGN PATENT DOCUMENTS

| | | | |
|---|---|---|---|
| 234,806 | 8/1961 | Australia | 297/442 |

*Primary Examiner*—Paul R. Gilliam
*Assistant Examiner*—Victor N. Sakran
*Attorney, Agent, or Firm*—Andrus, Sceales, Starke & Sawall

[57] ABSTRACT

A multishelf cabinet, open at the front, is made up of a back and two end members joined by block hinges at the upright corners for folding of the ends inwardly against the back. The back is split vertically at the center and the two pieces are hinged together for folding backwardly upon each other. When open a plurality of shelves fit within the cabinet space provided and have tenons extending through mortises in the back and the ends. The ends of the tenons have vertical holes into which wooden clothespins fit to secure the assembly together. A canvas or wooden front may be provided with suitable fastenings to protect the storage items placed on the shelves.

3 Claims, 6 Drawing Figures

Fig.1
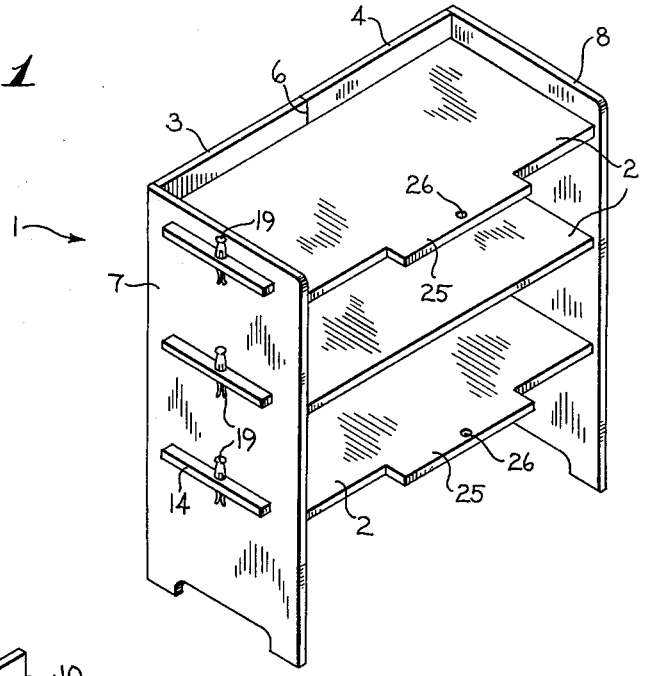
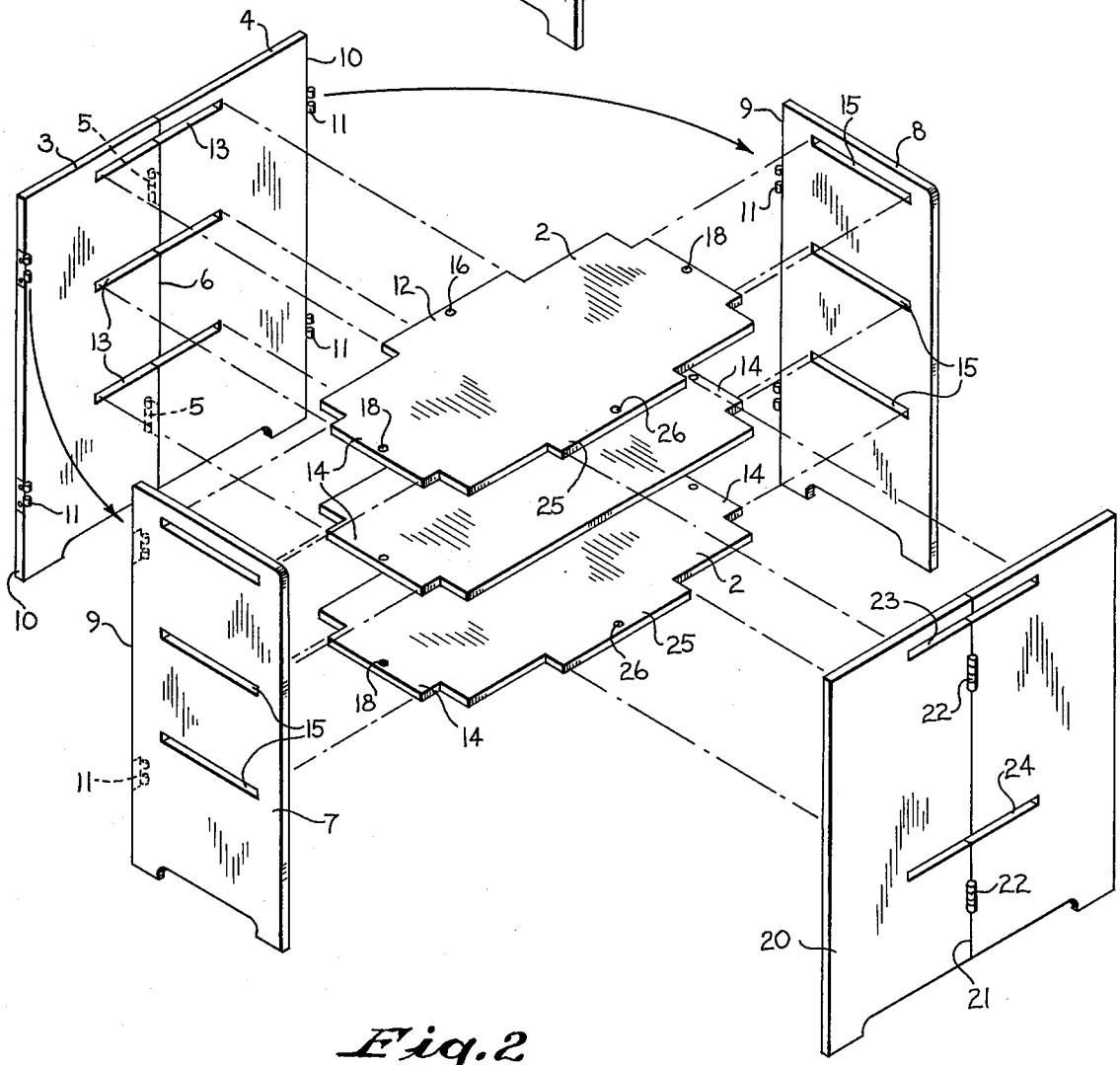
Fig.2

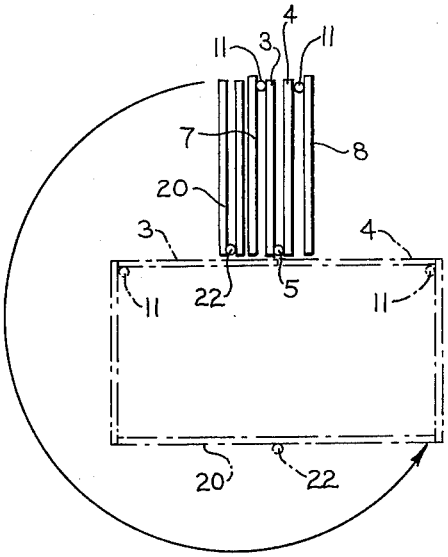
Fig.3
Fig.4
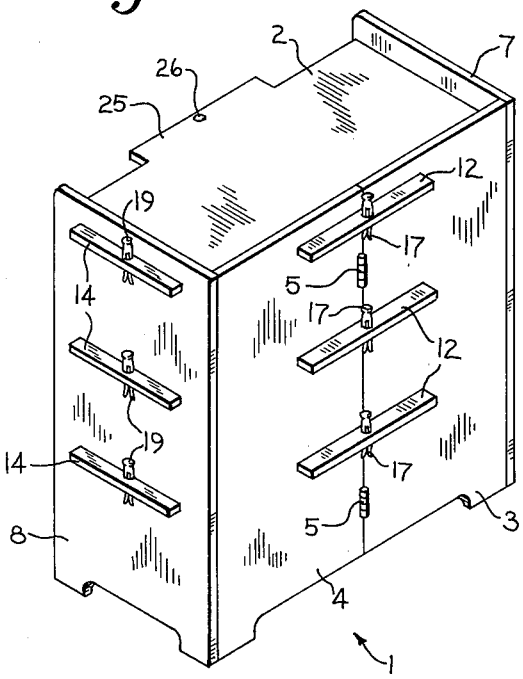
Fig.6
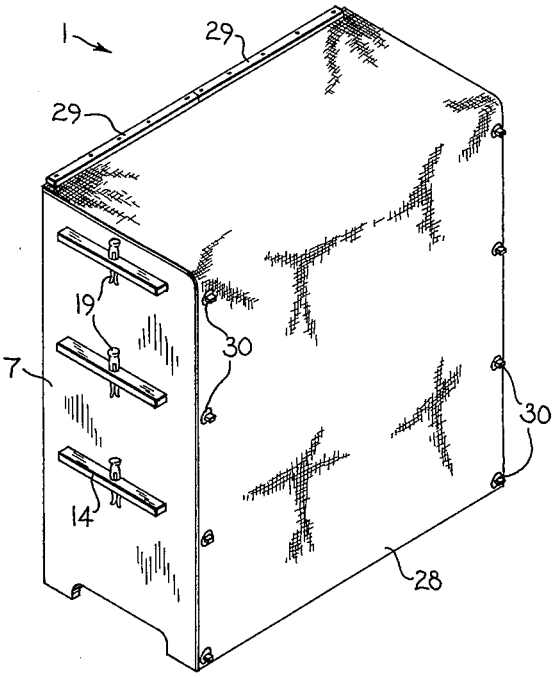
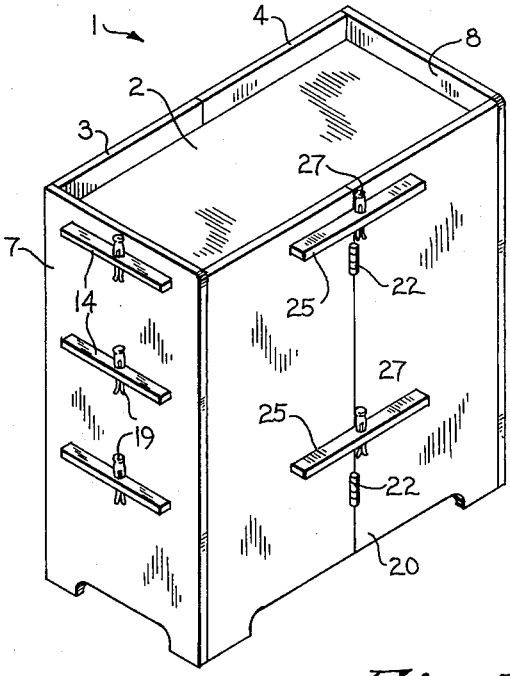
Fig.5

COLLAPSIBLE CAMP SUPPLY UNIT

BACKGROUND OF THE INVENTION

1. Field of the Invention

This invention relates to a collapsible camp supply unit usable by campers when they reach a campsite to hold their groceries and/or other items for handy use. While traveling the items are generally packed away in boxes and the unit is folded for ready carrying.

2. Description of the Prior Art

Applicant is unaware of any collapsible camp supply unit.

The nearest art may be the various collapsible stoves for campers, as exemplified by U.S. Pat. No. 2,424,665 issued to T. R. Pope, Sr.

Also, in some of the wooden furniture art there are designs which utilize tenons and mortises for assembly of chairs and various other items. These are exemplified by such U.S. Pat. as No. 3,485,527, No. 3,527,497 and No. 3,788,700.

In none of these is there disclosed a structure suitable for applicant's purpose.

SUMMARY OF THE INVENTION

The collapsible camp supply unit of the present invention is constructed with a three sided outer shell of generally four upright pieces of corresponding height and width hinged together to open from a folded condition to a position in which the two opposite ends of a cabinet area are joined by the intermediate pieces extending across the back.

A plurality of shelves are secured in vertically spaced relation by individual tenons at their back and end edges extending through corresponding slots or mortises in the respective ends and back of the unit.

The entire assembly is secured together by clothespins or other suitably tapered plugs inserted in vertical holes in the exposed end portions of the tenons.

The front of the unit may be closed by a suitable canvas drop having its upper edge secured to the upper edge of the back, or by a separate hinged two piece board secured to the shelves by tenons and mortises similar to those described above.

BRIEF DESCRIPTION OF THE DRAWING

The invention is illustrated in the accompanying drawings showing the preferred embodiment presently contemplated by applicant.

FIG. 1 is a perspective view of the assembled unit of the invention;

FIG. 2 is an exploded view of the unit;

FIG. 3 is a top plan view illustrating the shell parts in folded relation and in dotted open position;

FIG. 4 is a rear perspective view of the assembly of FIG. 1;

FIG. 5 is a view similar to FIG. 1 showing the application of a front closure board to the unit; and FIG. 6 is a view similar to FIG. 1 showing the application of a canvas closure to the unit.

DESCRIPTION OF THE PREFERRED EMBODIMENTS

The collapsible camp supply unit illustrated in the drawing comprises in general a three sided outer shell 1 of foldable sections hinged together, and a plurality of shelves 2 removably secured therein.

The outer shell 1 has four sections of the same height and width: the two back sections 3 and 4 being secured together by hinges 5 along a vertical parting line 6 to be folded back upon one another in collapsed relation and to be extended to provide back panels in common plane when ready for use, and the two opposite end sections 7 and 8 being secured at their rear edges 9 to the outer edges 10 of the corresponding back panels 3 and 4 by hinges 11 to fold inwardly as the panels 3 and 4 are collapsed to folded position as shown in FIG. 3.

The three shelves 2 illustrated are rectangular to fit within the cabinet space provided by the open shell.

The back edge of each shelf 2 has a tenon 12 extending for a part of its length centrally thereof, and which fits through a corresponding mortise or slot 13 extending partially across the two back panels 3 and 4 from the parting line 6 to either side.

Each end of each shelf 2 has a tenon 14 which fits through a corresponding mortise or slot 15 in the adjacent end panel 7 or 8, as the case may be.

The three slots 13 are horizontal and spaced vertically from one another to determine the spacing of the shelves 2 in the assembled unit.

The three slots 15 in each end panel 7 and 8 are spaced the same as slots 13 with corresponding slots 13 and 15 disposed in the same general horizontal plane.

Each tenon 12 extends through its corresponding slot 13 sufficiently to provide for a central hole 16 in the tenon for receiving a bifurcated wooden clothespin 17 or other yieldable or tapered wooden pin for securing the tenon against possible displacement relative to the back and at the same time secure the back panels to the shelf.

Each tenon 14 extends through its corresponding slot 15 sufficiently to provide for a central hole 18 in the tenon for receiving a bifurcated wooden clothespin 19 or other yieldable or tapered pin for securing the tenon against possible displacement relative to the corresponding end panel and at the same time secure the end and back panels to the shelf and against folding.

The unit thus described is ideal for campers in providing shelf space at a campsite that is usable in providing access to many items which otherwise remain packed away and become difficult to find.

It can be readily assembled when making camp and disassembled when breaking camp and takes very little space for transportation.

If desired the front of the unit may be closed by a foldable front board 20 constructed of two panels secured together along a central vertical parting line 21 by hinges 22, as shown in FIG. 5.

The front board 20 may have two horizontal slots 23 and 24 spaced vertically to correspond with the spacing of the upper and lower shelves 2 and extending across the parting line 21 to receive tenons 25 on the front edge of the corresponding upper and lower shelves 2.

Each tenon 25 has a vertical hole 26 therethrough for receiving a wooden bifurcated clothespin 27 or other yieldable or tapered pin to secure the front board to the unit and against folding.

FIG. 6 illustrates an alternative closure for the unit in which a canvas drop 28 is secured at its upper edge by any suitable means such as slats 29 nailed to the upper edge of back panels 3 and 4 with the edge portion of the canvas therebetween.

The body of canvas drop 28 extends over the top of the unit and down the front to the bottom and can be secured at the side edges by suitable turn fasteners 30 spaced therealong.

Various modes of carrying out the invention are contemplated as being within the scope of the following claims particularly pointing out and distinctly claiming the subject matter which is regarded as the invention.

I claim:

1. A collapsible camp supply unit comprising four rigid rectangular panels of substantially equal height and substantially equal width, hinges joining two of said panels together along adjacent vertical edges to provide a planular back for the unit with said joint foldable frontward, the other two panels constituting end panels for the unit extending forwardly from the opposite side edges of said planular back, hinges joining the rear vertical edge of each end panel to the corresponding adjacent side edge of said back to provide for folding of said end panel inwardly against the corresponding adjacent back panel, a plurality of separate vertically spaced horizontal shelves having edge tenons extending through corresponding individual slots in said back and end panels, and removable pins extending through said tenons on the outside of said unit to secure the said panels and shelves rigidly together to provide a storage unit, said last named hinges additionally providing for outward movement of said end panels when said pins are removed to release said tenons for ready removal of said shelves and subsequent folding of said panels upon one another.

2. The construction of claim 1 and a rigid front closure comprising two front panels of substantially the dimensions of said two back panels, hinges joining adjacent vertical edges of said two front panels to provide for folding of one panel upon the other when not in use, a plurality of said shelves having forwardly extending tenons adapted to extend through corresponding individual slots in said front closure, and removable pins extending through said tenons to secure said front closure in place with the opposite side edges thereof inset between said end panels tightly closing and providing additional rigidity for said unit, one of said shelves constituting a top closure for said unit.

3. The construction of claim 1 and flexible closure means secured to said back panels and extending over the front of the unit for closing the same, said flexible means being foldable with said back panels.

* * * * *